United States Patent [19]

Hofmann et al.

[11] Patent Number: 5,002,816

[45] Date of Patent: Mar. 26, 1991

[54] SEALING STRIP FOR A RIDGING

[75] Inventors: Karl-Heinz Hofmann, Mücke; Wilhelm Röttger, Heusenstamm, both of Fed. Rep. of Germany

[73] Assignee: Braas GmbH, Fed. Rep. of Germany

[21] Appl. No.: 269,336

[22] Filed: Nov. 10, 1988

[30] Foreign Application Priority Data

May 10, 1988 [DE] Fed. Rep. of Germany ..... 3816015

[51] Int. Cl.[5] ..... E04D 1/36

[52] U.S. Cl. ..... 428/138; 52/57; 52/58; 52/60; 52/631; 428/33; 428/53; 428/57; 428/141; 428/192; 428/209; 428/219; 428/220; 428/457; 428/461

[58] Field of Search ..... 52/57, 58, 60, 631; 428/141, 138, 33, 53, 57, 192, 209, 219, 220, 457, 461

[56] References Cited

U.S. PATENT DOCUMENTS

| | | | |
|---|---|---|---|
| 4,462,190 | 7/1984 | Allen | 52/58 |
| 4,544,593 | 10/1985 | Borgert | 428/80 |
| 4,573,291 | 3/1986 | Hofmann | 52/43 |
| 4,655,009 | 4/1987 | DeGraan | 52/58 |
| 4,664,390 | 5/1987 | Housemann | 52/58 |
| 4,750,301 | 6/1988 | Croxford | 52/58 |

FOREIGN PATENT DOCUMENTS

| | | | |
|---|---|---|---|
| 8703323 | 6/1987 | PCT Int'l Appl. | 52/58 |
| 2184685 | 7/1987 | United Kingdom . | |

*Primary Examiner*—Patrick J. Ryan
*Assistant Examiner*—Archene A. Turner
*Attorney, Agent, or Firm*—Pollock, Vande Sande & Priddy

[57] ABSTRACT

For sealing the ridge cover of a pitched roof there is used a sealing strip (10) comprising a center strip (11) with an air-permeable, water-repellent and drifting snow-tight non-woven material (12) including side strips (20, 30) contiguous therewith, at least the outer longitudinal edges of said side strips being adaptable to the top surfaces of roofing tiles (2'). Each side strip comprises soft, extensible polyisobutylene sheet strips having an expanded metal embedded therein which exhibits a longitudinal extensibility of 50 to 150% and a transverse extensibility of >20% and a recovery of >5%.

27 Claims, 4 Drawing Sheets

SEALING STRIP FOR A RIDGING

Figure 1:
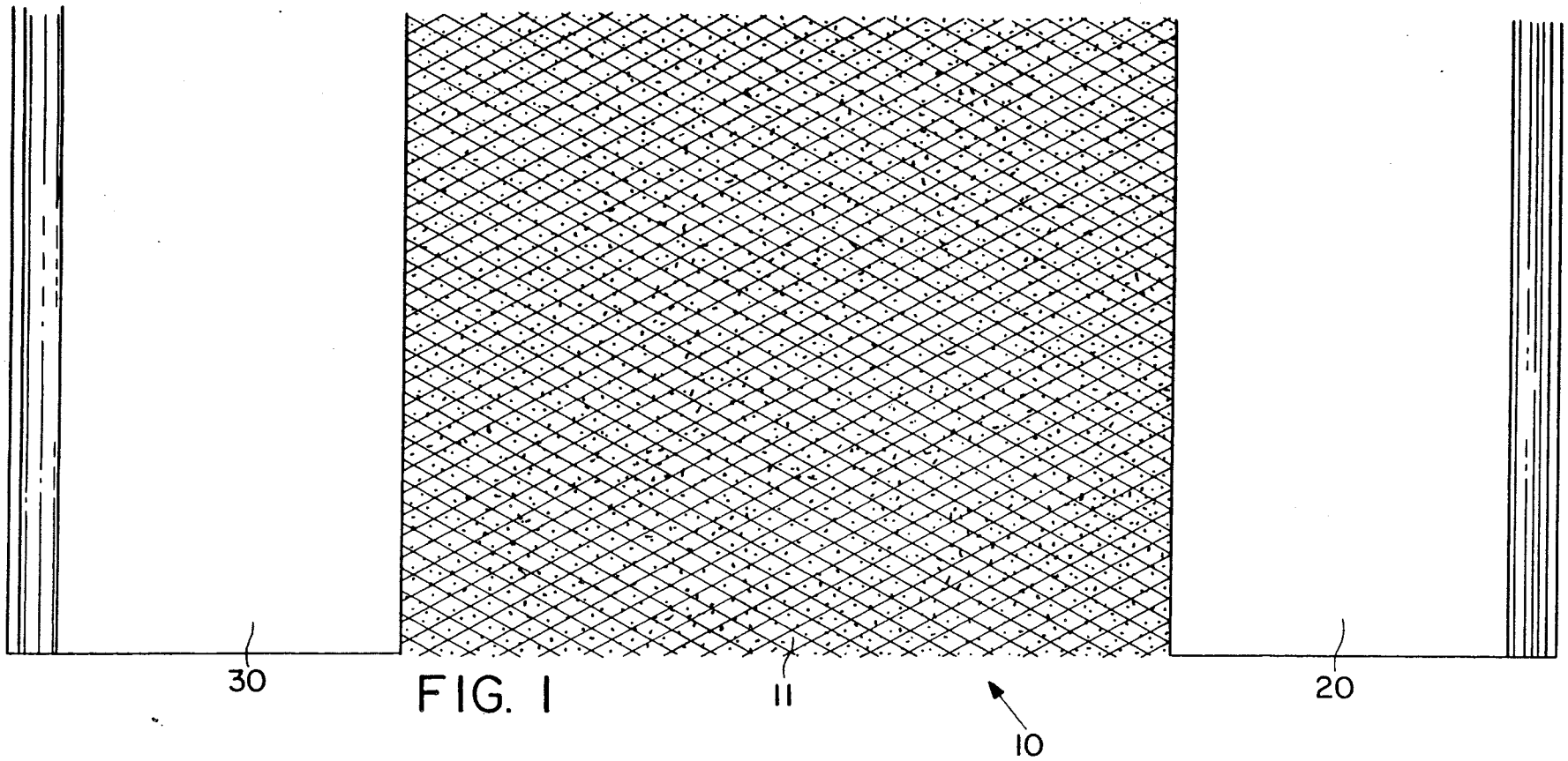

The present invention is directed to a sealing strip for a ridge capping, said sealing strip comprising a center strip which is intended for placement on a ridge beam and permits the passage of air, and side strips which are contiguous with said center strip and can be adapted at least with their outer longitudinal edges to the top surface of plain roofing tiles.

Typically, sealing strips of the specified kind are covered by cappings which constitute the top cover of the ridge, and the sealing strips must be in snug engagement with the top surface of the roofing tile edges facing the ridge so as to achieve good sealing action against rain and drifting snow.

Such a sealing strip, which is also universally useful with the most varied roofing tiles and roof pitches and by means of which sealing against rain and drifting snow and also venting of the roof space is made possible, has been known from EP-PS 0,117,391. This sealing strip comprises a flexible carrier strip which along one or both longitudinal edges is provided with a special marginal portion. The marginal portion is of comb-like structure and formed of elastic material, and the teeth of the marginal portion are joined by a flexible border strip which bridges the tooth gaps and allows the teeth to be spread apart. The border strip covering the tooth gaps may be made from an air-permeable non-woven material which aids in venting the roof space. Venting is also made possible when a part of the carrier strip which is sideways of the ridge beam is provided with vent holes and has upright supports for the cappings. The special design of the marginal portion provides for excellent adaptation to the most varied surfaces of roofing tiles. However, the manufacture of such a sealing strip is expensive.

It is therefore the object of the present invention to provide a coilable sealing strip for a ridging, which is of simple structure and can be manufactured at low cost, ensures venting of the roof space, can be adapted either manually or with simple means also to more highly profiled roofing tiles of different kinds in a visually attractive way, and which permanently retains the shape given it in the adaptation process even under varying weather conditions In accordance with the present invention this object is solved by the feature that the center strip comprises an air-permeable, water-repellent and drifting snow-tight non-woven material, and each side strip is made from soft extensible polyisobutylene (PIB) sheet strips having an expanded metal embedded therein which has a longitudinal extensibility of 50 to 150% and a transverse extensibility of $\leqq 20\%$ and a recovery of $\leqq 5\%$.

It has been known to use covering material which can be plastically deformed also to cover cracks, seams, gaps, openings, junctions and the like at water-carrying locations of buildings, roofs and parts thereof (DE-OS 3,642,063). This sheet-like, web-like or strip-like covering material, which can be manually shaped even at low temperatures, is made from a PIB substrate in which an expanded metal is embedded which has a longitudinal extensibility of 50 to 150%, a transverse extensibility of $\leqq 20\%$ and a recovery of $\leqq 5\%$. So far, a covering material of this type has not been used in conjunction with a ridge capping. Also, no means are provided for venting the roof space.

Advantageous embodiments and further improvements of the sealing strip according to the present invention will be apparent from the subclaims.

Although it is sufficient to provide the expanded metal only in the two side strips and to make the center strip from non-woven material only, a preferred embodiment of the invention provides that the expanded metal also bridges the center strip and is made to be integral therewith, whereby a still greater safety can be achieved when the sealing strip is secured to a ridge beam.

It is easy to obtain a permanent bond between the non-woven material of the center strip and the strip-like PIB sheet of the side strips when the longitudinal edges of the non-woven material are glued in overlapping relationship to the respective inner longitudinal edge of the strip-like PIB sheet of a side strip.

In accordance with a further advantageous embodiment the free longitudinal edges of the side strips are provided on their lower surface, which is placed onto the roofing tiles, with a pressure sensitive layer protected by release paper The pressure sensitive layer may be selected from a variety of known rubber or plastic compositions such as soft butyl rubber. By means of this additional adhesive layer, which may be a tape or ribbon, it is possible after removal of the release paper and pressing of the side strips against the top surface of the roofing tiles to achieve additional sealing by bonding.

Preferably, the non-woven material is made from weather-proof synthetic fibers and has an air permeability of at least 1,000 $l/s/m^2$ so as to ensure good venting of the inner roof space through the ridge. A suitable, non-woven material is one made from polypropylene fibers having a weight per unit area of 20 to 200 $g/m^2$, especially 60 $g/m^2$. Such a non-woven material is weather and alkali-proof and has sufficient strength to secure the sealing strip via the center strip to the ridge beam.

The expanded metal mainly serves as reinforcing element for the side strips and ensures that these can be plastically deformed. The high longitudinal extensibility of the side strips also permits good adaptation to roofing tiles having complex three-dimensional shape. The comparatively small transverse extensibility results in the expanded metal having clean and mostly straight longitudinal edges. Suitable materials for the expanded metal are rust-proof metals, especially aluminum and lead. An especially advantageous expanded metal is one which is made from inherently soft aluminum which after stretching has additionally been soft-annealed. Such an expanded metal has practically no power of recovery. Depending on the desired extensibility the expanded metal may have a thickness of material and a web width of 0.3 to 1.5 mm, a mesh length of 4 to 20 mm and a mesh width of 2 to 15 mm. This expanded metal preferably has a longitudinal tensile strength of 10 to 80 N/cm and a transverse tensile strength of $\geqq 100$ N/cm.

The side strips are preferably made from PIB sheet material which is non-adhesive within the temperature range relevant to the field of application; this material may contain the usual additives such as antioxidants, UV-absorbers, coloring pigments, inorganic fillers and the like. Preferably, the PIB sheet material has a tensile strength of $\leqq 10$ N/mm and an extensibility of $\geqq 50\%$. In view of these mechanical values, breakage of the sheet material is prevented even in case of bending.

For example, the PIB sheet material may be composed of the following ingredients:

| | | |
|---|---|---|
| 100 | parts by weight | PIB having an average molecular weight of $1.3 \times 10^6$; |
| 50–80 | parts by weight | PIB having an average molecular weight of $0.4 \times 10^6$; |
| 1–2 | parts by weight | non-coloring antioxidants; |
| 1–4 | parts by weight | non-coloring UV-absorber; |
| 20–60 | parts by weight | coloring pigments; and |
| 100–130 | parts by weight | uncoated amorphous chalk. |

The sealing strip may preferably have a width of about 200 to 300 mm. Depending on the width of the cappings used on the ridge, sealing strips having a width of 230 and 275 mm have been proven especially suitable in practice. Each side strip has a width of about 60 to 90 mm, especially 75 mm. The expanded metal is embedded in the PIB sheet material substantially across the whole width of the side strips. The layer thickness of the side strips is approximately 1.5 to 2.5 mm; for example, the expanded metal may be sandwiched in between two PIB sheet strips each having a thickness of c.0.7 mm, so that the sheet strips are joined to each other through the meshes of the expanded metal.

Sealing strips of this type are preferably manufactured with a length of about 10 m and shipped as rolls. In order to prevent undesirable adhesion of adjacent PIB sheet material during storage and transport, each side strip may on one side be protected by a release paper. Such rolls have a maximum weight of about 5 kg, they are easy to store and transport and they can readily be handled and mounted even under difficult conditions on a pitched roof. The rolls are unwound over the ridge beam and are secured thereto with nails or the like. This is an optimum craftsman-like way of sealing the ridge area on a pitched roof.

Figure 2:
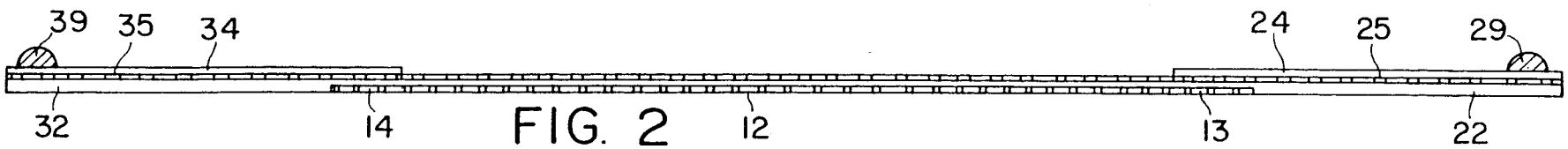
Figure 3:
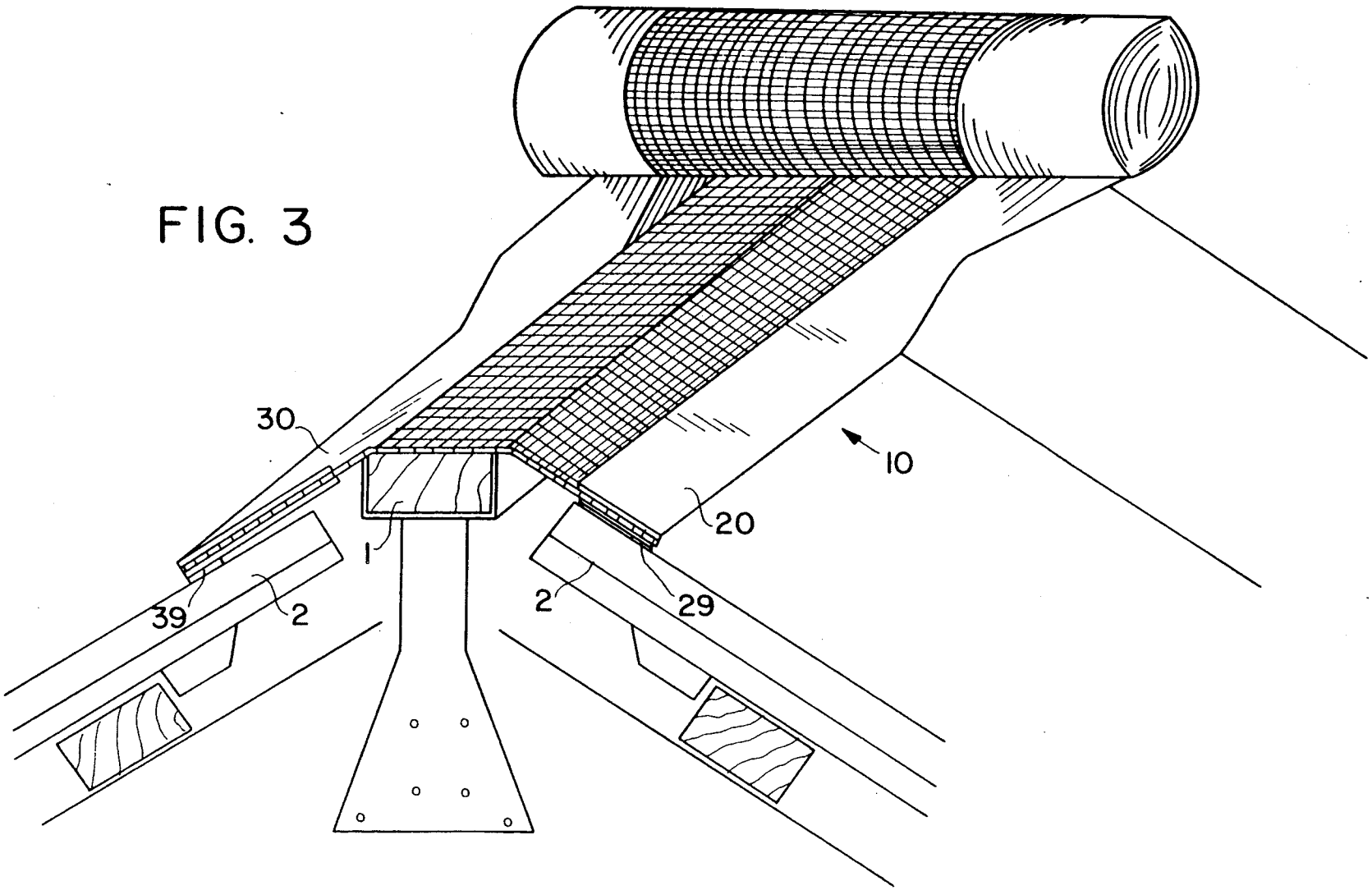
Figure 4:
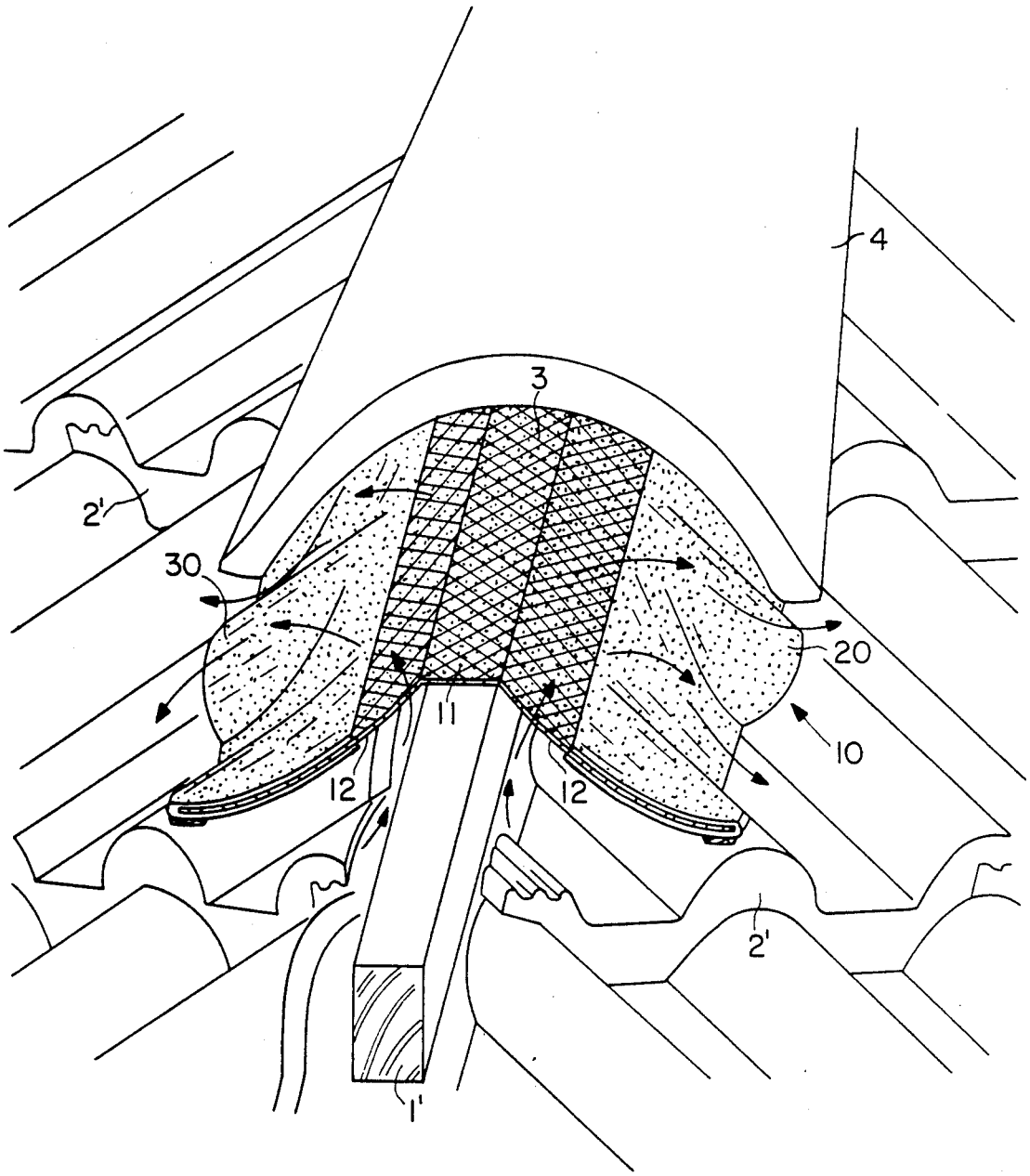
Figure 5:
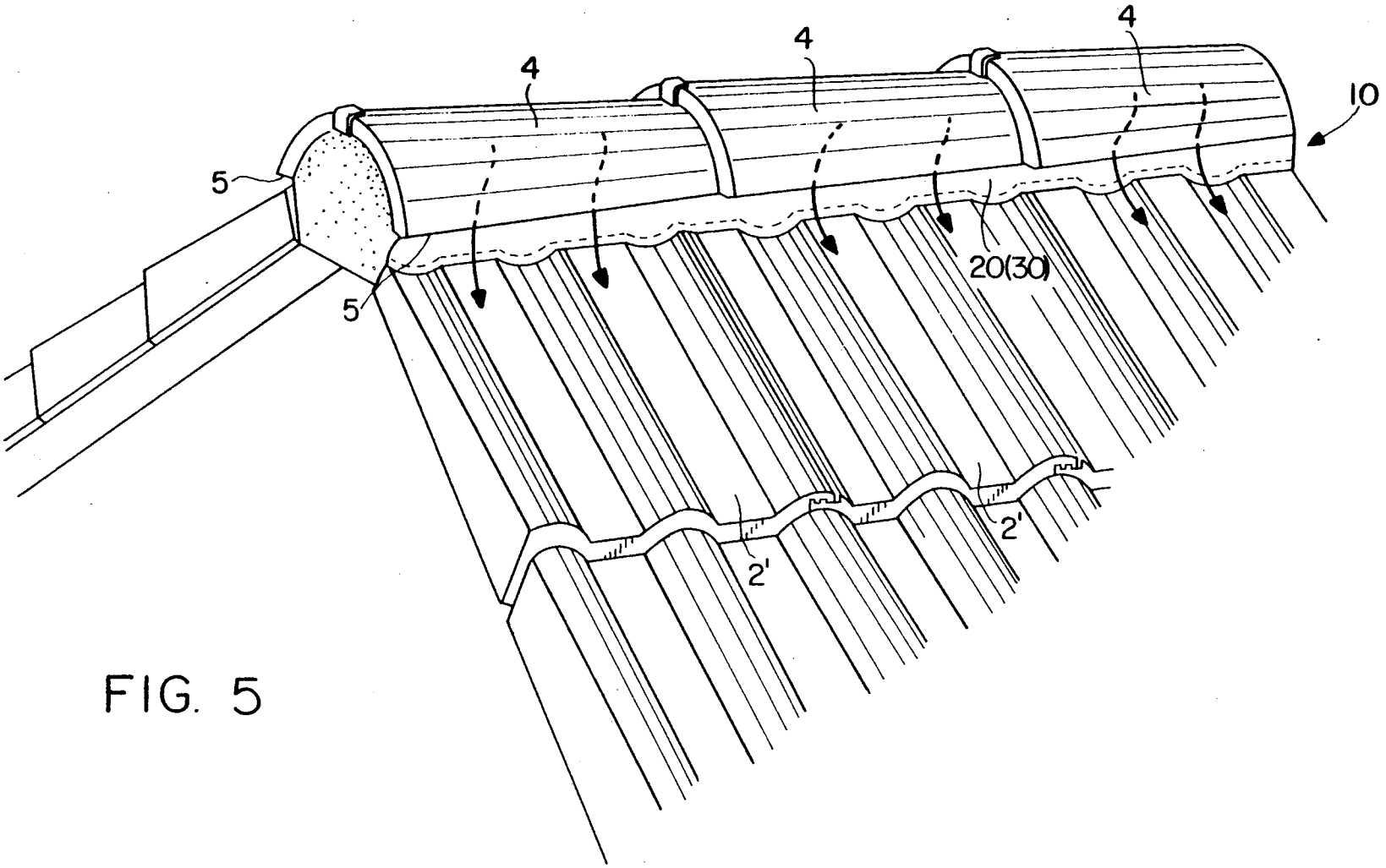

Below, preferred embodiments of the invention will be explained in detail with reference to the drawing, in which:

FIG. 1 is a portion of the sealing strip of the invention, as viewed from the side of placement, FIG. 2 is a cross-section of the sealing strip of FIG. 1, FIG. 3 is a schematic perspective view of the sealing strip of the invention when being mounted on the ridge beam of a roof, FIG. 4 is a schematic perspective view of a portion of a sealing strip secured to the ridge beam of a roof and partially covered by a capping, and FIG. 5 is a finished ridging in which the sealing strip according to the invention has been used.

As will be apparent especially from FIGS. 1 and 2, the sealing strip 10 of the present invention comprises a center strip 11 and the two side strips 20 and 30. The center strip 11 includes a non-woven material 12 of polypropylene fibers impregnated so as to be water-repellent. In the illustrated embodiment an expanded metal 25, 35 is provided which also bridges the center strip 11 and which in the vicinity of the side strips 20 and 30 is respectively sandwiched between two PIB sheet strips 22, 24 and 32, 34, respectively. The two longitudinal edges 13 and 14 of the non-woven material 12 are overlappingly bonded to the inner longitudinal edge of the PIB sheet strips 22 and 32, respectively. The PIB sheet strips 24 and 34, which are to be placed onto the roofing tiles, are provided along their longitudinal edges with a pressure sensitive layer 29 and 39 in the form of a tape.

FIG. 3 illustrates schematically the mounting of the sealing strip 10 of the present invention on the ridge of a roof which is roofed with plain tiles 2. The sealing strip 10 is supplied as a roll and is unwound and secured on the ridge beam 1. Thereupon the side strips 20 and 30, which are provided with the pressure sensitive layer 29, 39, are adapted to the shape of the top surface of the ridge-side roofing tiles 2.

FIG. 4 illustrates the sealing strip 10 of the invention after mounting on the ridge of a roof which is roofed with shaped roofing tiles 2'. As shown, the middle portion of the center strip 11 rests on the top of the ridge beam 1'. This portion is secured to the ridge beam by spaced fastening elements such as nails 3. The middle portion of the center strip 11 has adjacent side portions through the air-permeable non-woven material 12 of which the roof space can be vented as indicated by arrows. The side strips 20 and 30 are shaped to match the top surfaces of the roofing tiles 2'. After shaping of the sealing strip 10 the cappings 4 which terminate the ridge are placed thereon as indicated.

With a finished roof, as will be apparent from FIG. 5 which shows a ridging, the sealing strips 10 are continuously covered by overlappingly placed cappings 4, so that only the eaves-side part of the side strips 20 and 30 of the sealing strips between the longitudinal edges 5 of the cappings and the shaped roofing tiles 2' placed therebeneath is visible from outside. As indicated by arrows, continuous venting of the roof space is made possible through the gap which remains between the longitudinal edges 5 of the cappings 4 and the side strips 20 and 30 of the sealing strip.

We claim:

1. A sealing strip for a ridging, comprising a center strip intended for placement on a ridge beam and permitting the passage of air therethrough, and side strips contiguous therewith wherein said side strips contain outer longitudinal edges for profiling to the top surfaces of roofing tiles, characterized in that the center strip comprises an air-permeable, water-repellent and drafting snow-tight non-woven material, and each of said side strips is made from soft extensible polyisobutylene. PIB, sheet strips having an expanded metal embedded therein, said expanded metal exhibiting a longitudinal extensibility of 50 to 150% and a transverse extensibility of $\leqq 20\%$ and a recovery of $\leqq 5\%$.

2. The sealing strip as claimed in claim 1, characterized in that the expanded metal also bridges the center strip and is of integral structure.

3. The sealing strip as claimed in claim 1 characterized in that the non-woven material of the center strip contains longitudinal edges respectively bonded to a longitudinal edge of the PIB sheet strip of a side strip.

4. The sealing strip as claimed in claim 1 characterized in that the side strips contain longitudinal edges on the sides thereof which are for placement on roofing tiles with a pressure-sensitive layer located on said longitudinal edges on the side thereof, and wherein said pressure-sensitive layer is covered by release paper.

5. The sealing strip as claimed in claim 1, characterized in that the non-woven material is made from weather-proof synthetic fibers and exhibits an air permeability of at least 1,000 $l/s/m^2$.

6. The sealing strip as claimed in claim 1, characterized in that the non-woven material is made from polypropylene fibers and has a weight per unit area of 20 to 200 $g/m^2$.

7. The sealing strip as claimed in claim 1, characterized in that the expanded metal is made from inherently soft aluminum which has additionally been soft-annealed after stretching.

8. The sealing strip as claimed in claim 1, characterized in that the width of the sealing strip is 200 to 300 mm.

9. The sealing strip as claimed in claim 1, characterized in that each side strip has a width of 60 to 90 mm.

10. The sealing strip as claimed in claim 2, characterized in that the non-woven material of the center strip contains longitudinal edges respectively bonded to a longitudinal edge of the PIB sheet strip of a side strip.

11. The sealing strip as claimed in claim 2, characterized in that the side strips contain longitudinal edges on the sides thereof which are for placement on roofing tiles with a pressure-sensitive layer located on said longitudinal edges on the sides thereof, and wherein said pressure sensitive layer is covered by a release paper.

12. The sealing strip as claimed in claim 3, characterized in that the side strips contain longitudinal edges on the sides thereof which are for placement on roofing tiles with a pressure-sensitive layer located on said longitudinal edges on the sides thereof, and wherein said pressure sensitive layer is covered by a release paper.

13. The sealing strip as claimed in claim 2, characterized in that the non-woven material is made from weather-proof synthetic fibers and exhibits an air permeability of at least 1,000 $l/s/m^2$.

14. The sealing strip as claimed in claim 3, characterized in that the non-woven material is made from weather-proof synthetic fibers and exhibits an air permeability of at least 1,000 $l/s/m^2$.

15. The sealing strip as claimed in claim 4, characterized in that the non-woven material is made from weather-proof synthetic fibers and exhibits an air permeability of at least 1,000 $l/s/m^2$.

16. The sealing strip as claimed in claim 2, characterized in that the non-woven material is made from polypropylene fibers and has a weight per unit area of 20 to 200 $g/m^2$.

17. The sealing strip as claimed in claim 3, characterized in that the non-woven material is made from polypropylene fibers and has a weight per unit area of 20 to 200 $g/m^2$.

18. The sealing strip as claimed in claim 4, characterized in that the non-woven material is made from polypropylene fibers and has a weight per unit area of 20 to 200 $g/m^2$.

19. The sealing strip as claimed in claim 2, characterized in that the expanded metal is made from inherently soft aluminum which has additionally been soft-annealed after stretching.

20. The sealing strip as claimed in claim 2, characterized in that the width of the sealing strip is 200 to 300 mm.

21. The sealing strip as claimed in claim 2, characterized in that the width of the sealing strip is 230 mm.

22. The sealing strip as claimed in claim 2, characterized in that each side strip has a width of 75 mm.

23. The sealing strip as claimed in claim 3, characterized in that each side strip has a width of 75 mm.

24. The sealing strip as claimed in claim 1, characterized in that the width of the sealing strip is 230 mm.

25. The sealing strip as claimed in claim 1, characterized in that each side strip has a width of 75 mm.

26. The sealing strip of claim 1 wherein the non-woven material is made from polypropylene fibers having a weight per unit area of 60 $g/m^2$.

27. The sealing strip of claim 2 wherein the width of the sealing strip is 275 mm.

* * * * *